US011000079B2

(12) United States Patent
Honore et al.

(10) Patent No.: US 11,000,079 B2
(45) Date of Patent: May 11, 2021

(54) FLAT INFLATION DEVICE

(71) Applicant: IN&MOTION, Chavanod (FR)

(72) Inventors: Valentin Honore, Annecy (FR); Rémi Thomas, Annecy le vieux (FR); Pierre-François Tissot, Chignin (FR)

(73) Assignee: IN&MOTION, Chavanod (FR)

( * ) Notice: Subject to any disclaimer, the term of this patent is extended or adjusted under 35 U.S.C. 154(b) by 42 days.

(21) Appl. No.: 16/463,538

(22) PCT Filed: Nov. 27, 2017

(86) PCT No.: PCT/FR2017/053262
§ 371 (c)(1),
(2) Date: May 23, 2019

(87) PCT Pub. No.: WO2018/096299
PCT Pub. Date: May 31, 2018

(65) Prior Publication Data

US 2019/0373967 A1 Dec. 12, 2019

(30) Foreign Application Priority Data

Nov. 25, 2016 (FR) ..... 1661537

(51) Int. Cl.
*A41D 13/018* (2006.01)
*A63B 33/00* (2006.01)
(Continued)

(52) U.S. Cl.
CPC ..... *A41D 13/018* (2013.01); *A62B 33/00* (2013.01); *B63C 9/23* (2013.01); *F17C 13/084* (2013.01);
(Continued)

(58) Field of Classification Search
CPC .. B63C 9/00; B63C 9/15; B63C 9/155; B63C 9/23; B63C 9/08; B63C 9/125;
(Continued)

(56) References Cited

U.S. PATENT DOCUMENTS 3,147,885 A 9/1964 Sheridan
4,606,384 A 8/1986 Neukomm
(Continued)

FOREIGN PATENT DOCUMENTS

BE 337871 A 10/1926
GB 1122864 A 8/1968

OTHER PUBLICATIONS

Translation of International Preliminary Report on Patentability (Chapter I) dated Jun. 6, 2019, in corresponding International application No. PCT/FR2017/053262; 7 pages.
(Continued)

*Primary Examiner* — Lars A Olson
(74) *Attorney, Agent, or Firm* — Maier & Maier, PLLC

(57) ABSTRACT

A device for the inflation of an inflatable life vest, notable in that it includes a storage casing containing at least two cartridges of pressurized gas which are arranged side-by-side and touching one another to form a row, and a release casing comprising at least one striker device that makes it possible, in the event of activation, to puncture each of the said cartridges simultaneously or in succession to release the gas they contain in gaseous form to the outside of the inflation device through at least one orifice made on the release casing, the said storage and release casings being in the overall shape of a flattened hollow parallelepiped and joined together removably and in a manner that is gastight with respect to the gas contained in the said cartridges.

7 Claims, 2 Drawing Sheets

(51) Int. Cl.
*B63C 9/23* (2006.01)
*A62B 33/00* (2006.01)
*F17C 13/08* (2006.01)

(52) U.S. Cl.
CPC ..... *F17C 2221/013* (2013.01); *F17C 2270/0772* (2013.01)

(58) Field of Classification Search
CPC .. B63C 9/20; B63C 9/18; B63B 22/00; B63B 22/08; B63B 22/22; A41D 13/018; A62B 33/00; F17C 13/084; F17C 2221/013; F17C 2270/0772
USPC ..... 441/92, 93, 95; 222/5, 6
See application file for complete search history.

(56) References Cited

U.S. PATENT DOCUMENTS 5,732,752 A * 3/1998 Glessner ..... B63C 9/23 141/329
6,158,380 A 12/2000 Aschauer et al.
6,561,863 B1 5/2003 Campbell

OTHER PUBLICATIONS

Translation of International Search Report and Written Opinion dated Feb. 20, 2018 in corresponding International application No. PCT/FR2017/053262; 12 pages.

* cited by examiner

FLAT INFLATION DEVICE

FIELD

The present invention relates to the field of preventing and reducing injuries linked to a fall in general, in particular, in taking part in motorcycling, skiing or riding, and more specifically, an inflation device for an inflatable life vest.

BACKGROUND

With the democratisation of horse riding and skiing, and in particular skiing called "extreme skiing", such as off-piste skiing, it has been sought to develop systems intended to protect, during falls, motorcyclists, horse riders or skiers, and more specifically, the most exposed parts of their bodies such as, for example, the neck, the chest, the spine, the abdomen and the hips.

Thus, protections called "smart protections" have been developed. This type of protection is conventionally constituted of a very compact inflatable life vest, and capable of being inflated very quickly by a gas, during the fall of the wearer, to avoid the latter from violently impacting the ground. The functioning of this vest is similar to the functioning of airbags installed in vehicles.

Thus, the inflatable vest comprises a sealed airbag pocket capable of being inflated and being integrated in a textile and distributed around the body of the user so as to protect certain zones of the body previously identified, said pocket could be itself integrated in the form of lining of a jacket. Said inflatable vest also comprises an inflatable device connected to the two wheels or horse by a strap and capable of making it possible to release a gas, conventionally carbon dioxide $CO_2$, contained in a liquefied gas cartridge.

One of the main problems encountered during the development of these active protections is to make it possible for the quick and complete deployment of the inflatable life vest, said active protections furthermore not having to cause additional injuries to the users.

Yet, currently, according to the size of the inflatable vest, the gas cartridge can be large. Indeed, current inflatable devices are composed of a cylindrical $CO_2$ cartridge of diameter of 30 millimetres, and of a length of 140 millimetres. The inflatable device also comprises a striker device to puncture said cartridge and release the gas that it contains, the assembly thus obtained thus having generally the following dimensions:

length=210 to 230 millimetres,
width=40 to 45 millimetres,
thickness=35 to 40 millimetres.

Moreover, this type of inflatable devices is conventionally placed at the front of the inflatable vest, just under the chest, and can cause a discomfort, in particular for average-sized people (less than 1.70 metres) during taking part in motorcycling or riding. Indeed, the inflatable device can create compression points at the level of the groin and under the chest of the motorcyclist or rider, as the latter is very often in a slightly curved position towards the front.

In addition, at the level of appearance, the height and the thickness of these types of inflatable devices makes the clothes asymmetrical and therefore ungainly.

For these two reasons in particular, these types of inflatable devices are not very suitable for taking part in motorcycling or horse riding.

Moreover, during a fall onto the front of the wearer of the vest, the inflatable device is found "compressed" between the ground and the wearer, and can, given the dimensions of the cartridge, create a localised punching force at the level of the chest and/or of the abdomen and lead to lesions.

Finally, during the release of the gas ($CO_2$) which is stored in liquid state in the pressurised cartridge, the depression leads to the vaporisation of the $CO_2$. However, the vaporisation phenomenon requires a heat quantity input with the outside of the cartridge. In the absence of this heat input, the vaporisation is slowed down, even incomplete, which has the effect of a slower, even partial inflation of the vest, and therefore an increased risk of injuries for the wearer, during a fall.

Also, inflation devices such as those described, in particular in patent applications BE 337 871, GB 1 122 864 or also U.S. Pat. No. 6,561,863 are known, but the latter are complex to implement and lack reliability.

SUMMARY

The aim of the present invention is therefore to overcome the disadvantages cited above, and to present an alternative to the inflation devices for a known inflatable life vest by proposing a reliable, resistant inflation device which is easy to produce and to implement.

According to the first aim of the invention, an inflation device is therefore proposed for an inflatable life vest, comprising a storage casing containing at least two pressured gas cartridges which are arranged side-by-side and touching one another so as to form a row and a release casing comprising at least one striker device making it possible, in case of activation, to puncture simultaneously or successively each of said cartridges so as to release the gas that they contain, in gaseous form, to the outside of the inflation device through at least one orifice made on the release casing, said storage and release casings being in the overall shape of a flattened hollow parallelepiped and joined together removably and in a manner that is gastight to the gas contained in said cartridges, said inflation device being notable in that the release casing makes it possible for a successive puncturing of each of said cartridges and contains a first striker device associated with the cartridge located at one of the ends of the row of cartridges contained in the storage casing and at least one second striker device associated with the other cartridges, said first and second striker device(s) comprising:

- a tube inside which slides a piston equipped with a puncturing end arranged on the side of the associated cartridge,
- a thrust member capable of moving said piston between a "normal" position wherein the puncturing end of the piston is not in contact with the associated cartridge and an "activation" position wherein the puncturing end of the piston has punctured the associated cartridge, and
- a retaining member making it possible to maintain said piston in the "normal" position thereof and being mobile, in case of activation, so as to release the piston such that it is moved up to the "activation" position thereof under the action of the thrust member.

The retaining member of the first striker device is advantageously a pin capable of being engaged simultaneously in a retaining orifice of the release casing and in a cavity arranged in the piston to maintain it in the "normal" position, and disengaged to release said piston.

The retaining member of each second striker device is preferably a latch, mobile between a "blocking" position or it bears against the preceding piston, thus in the "normal" position, so as to maintain the following piston in the "normal" position thereof and a "release" position wherein it no longer bears against the preceding piston, thus in the "activation" position or in the immediate proximity of this position, so as to release the following piston in the "normal" position thereof and make it possible for it to join the "activation" position thereof under the action of the associated thrust member.

Advantageously, each thrust member is a helicoidal spring arranged between the piston and the end of the tube located opposite the storage casing.

According to an embodiment variant, the thrust member of each second striker device is formed by a portion of the gas contained in the preceding cartridge and injected between the piston and the end of the tube located opposite the storage casing.

BRIEF DESCRIPTION OF THE DRAWINGS

Other advantages and characteristics will best appear from the following description, of a specific embodiment example, given as a non-limiting example, of an inflation device for an inflatable life vest according to the invention, in reference to the appended figures, wherein.

DETAILED DESCRIPTION

Figure 1:
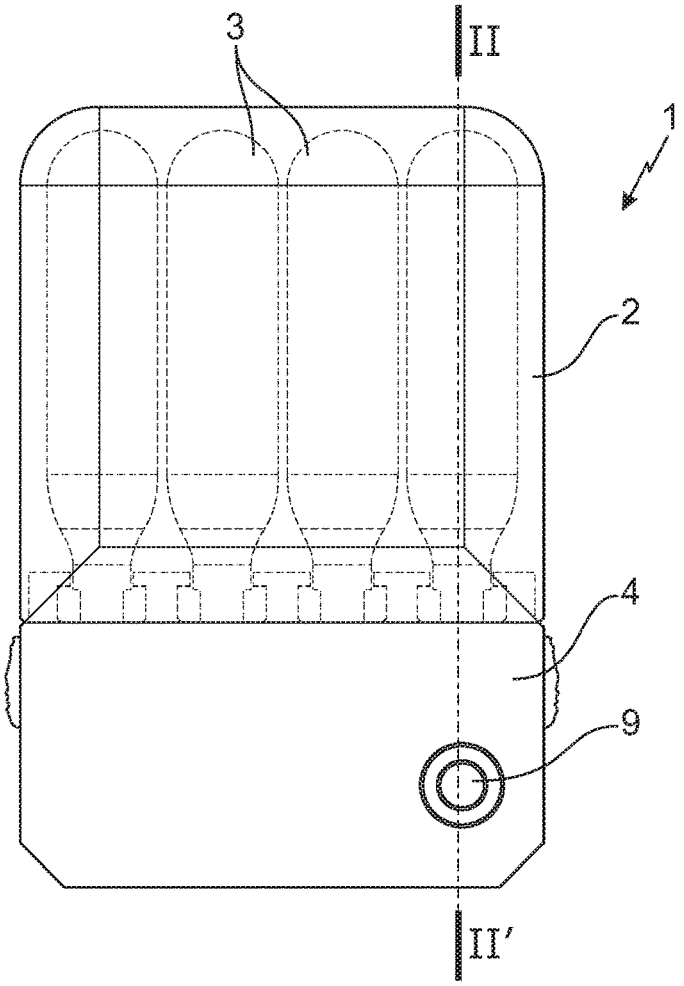
FIG. 1 is an outer front view of an inflation device according to the invention.

In reference to FIGS. 1 to 6, the inflation device 1 for an inflatable life vest has been represented, not represented in the figures. Said inflation device 1 comprises a storage casing 2 containing at least two, preferably four, pressurised gas cartridges 3, conventionally carbon dioxide, which are arranged side-by-side and touching one another so as to form a row and a release casing 4 making it possible, in case of activation, i.e. in the example described in case of fall of the wearer of the inflatable life vest, to puncture simultaneously or successively each of said cartridges 3 so as to release the gas that they contain in gaseous form inside the inflatable life vest in order to ensure the deployment thereof.

The storage casing 2 is in the overall shape of a flattened hollow parallelepiped comprising, advantageously on the lower face thereof, joining means 5, and is capable of containing fully the gas cartridges 3 oriented such that the puncturable end 31 being positioned on the side of said joining means 5.

The release casing 4 is in the overall shape of a flattened hollow parallelepiped comprising, advantageously on the upper face thereof, complementary joining means 6 capable of engaging with the joining means 5 of the storage casing 2 to guarantee a joining which is removable and gastight to the gas contained in said cartridges 3, storage casings 2 and release casings 4 together.

However, the storage casings 2 and release casings 4 can be slightly curved to be adapted to the morphology of the human body, without moving away from the scope of the present invention.

Here, by "lower" or "upper", this means elements or element portions located below or above, when the inflation device 1 according to the invention is used under normal conditions, namely joined on a vest worn by a standing individual, the storage casing 2 being placed above the release casing 4. These terms, "lower" and "upper" will be adapted if the inflation device 1 is joined differently, under normal conditions.

Moreover, here by "joining which is gastight to the gas contained in said cartridges 3", this means a joining making it possible to not necessarily obtain an absolute sealing that is difficult to achieve, but a sufficient sealing to guarantee that the gas released from the cartridges 3 will expand into the associated life vest in a sufficient quantity to ensure the complete inflation thereof, and not outside of the inflation device 1 according to the invention.

A detailed embodiment example of said joining means 5 of the storage casing 2 and complementary joining means 6 of the release casing 4 is described in another patent application arranged together in the name of the applicant and which is specifically based on this aspect.

Figure 2:
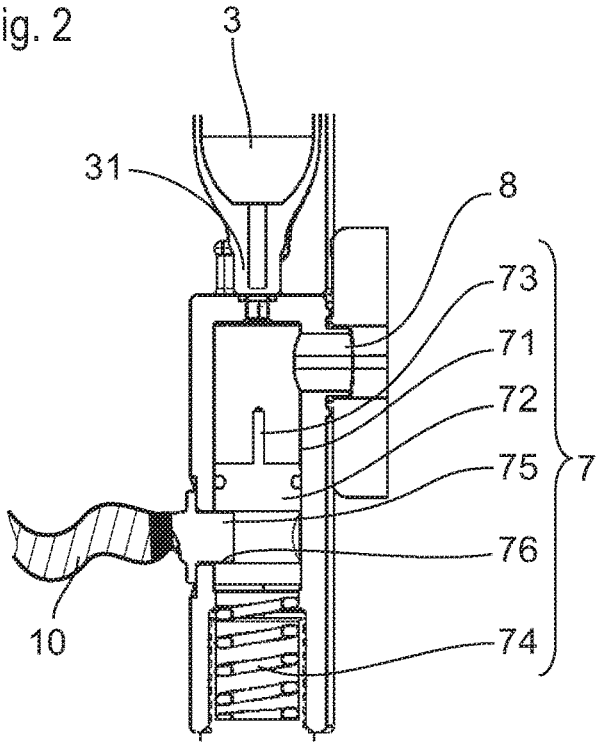
FIG. 2 is transversal cross-sectional views of the device of FIG. 1 along the axis II-II' before and after activation.
Figure 3:
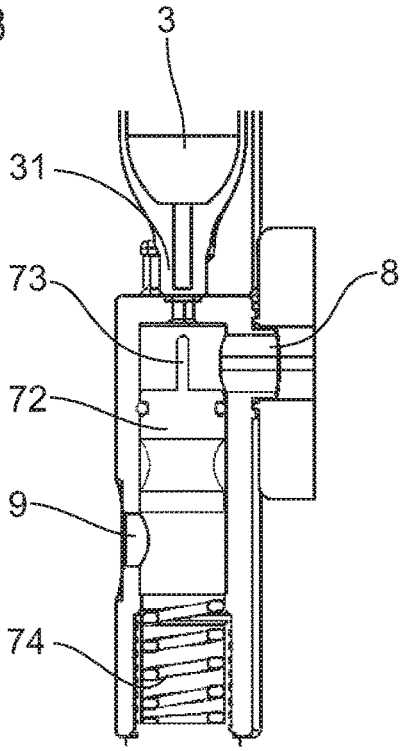
FIG. 3 is transversal cross-sectional views of the device of FIG. 1 along the axis II-II' before and after activation.

In reference to FIGS. 2 and 3, the release casing 4 comprises a striker device 7 associated with each of the cartridges 3 and capable of puncturing the associated cartridge 3, in case of fall of the wearer of the inflatable life vest, so as to release the gas that it contains in gaseous form inside said inflation life vest in order to ensure the deployment thereof. The release casing 4 further comprises an orifice 8 to the right of each striker device 7 putting through the inside of said release casing 4 and the outside of the inflation device 1 in order to make it possible for the passage of the gas inside said inflatable life vest.

Each striker device 7 thus comprises:

- a tube 71 inside which slides a piston 72 equipped with a puncturing end 73, for example of the blade or needle type, arranged on the side of the puncturable end 31 of the associated cartridge 3,
- a thrust member 74 capable of moving said piston 72 between a "normal" position wherein the puncturing end 73 of the piston 72 is not in contact with the associated cartridge 3 and an "activation" position wherein the puncturing end 73 of the piston 72 has punctured the puncturable end 31 of the associated cartridge 3, and
- a retaining member making it possible to maintain said piston 72 in the "normal" position thereof.

Said thrust member 74 is preferably a helicoidal spring arranged between the piston 72 and the end of the tube 71 located opposite the complementary joining members 6 of the release casing 4, i.e. opposite the storage casing 2.

The retaining member is advantageously a pin 75 capable of being engaged simultaneously in a retaining orifice 9 of the release casing 4 and in a cavity 76 arranged in the piston 72 to maintain it in the "normal" position, and secured to a strap 10 mechanically connecting said pin 75 to a fixed point of the motorcycle or the saddle of the horse. Thus, in case of activation, i.e. in case of disengagement of the motorcyclist with respect to their motorcycle or of the rider with respect to the horse, the traction force exerted by the strap 10 will disengage the pin 75 and release the piston 72, which under the effect of the thrust exerted by the thrust member 74 will come into the "activation" position and bore the associated cartridge 3 so as to release the gas inside said inflatable life vest in order to ensure the deployment thereof.

This configuration is certainly effective, but has the disadvantage of needing more straps 10 than cartridges 3, which can be particularly bulky and difficult to implement.

Figure 4:
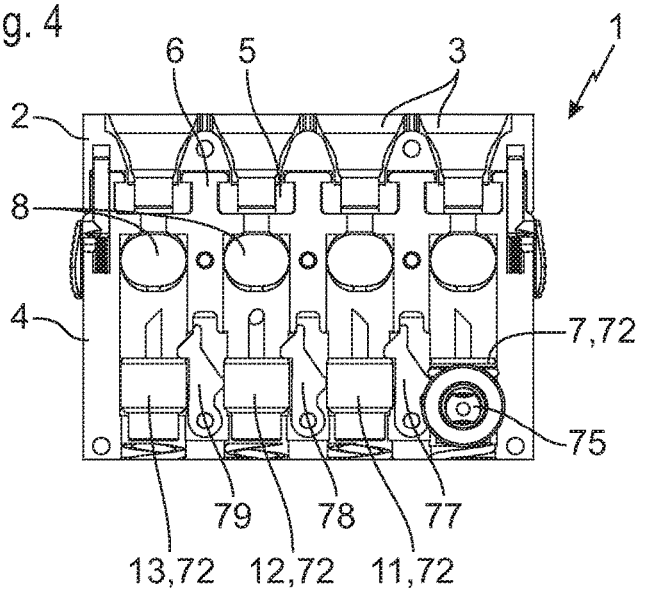
FIG. 4 is partial front cross-sectional views of an embodiment variant of the device of FIG. 1 at different steps of the activation.
Figure 5:
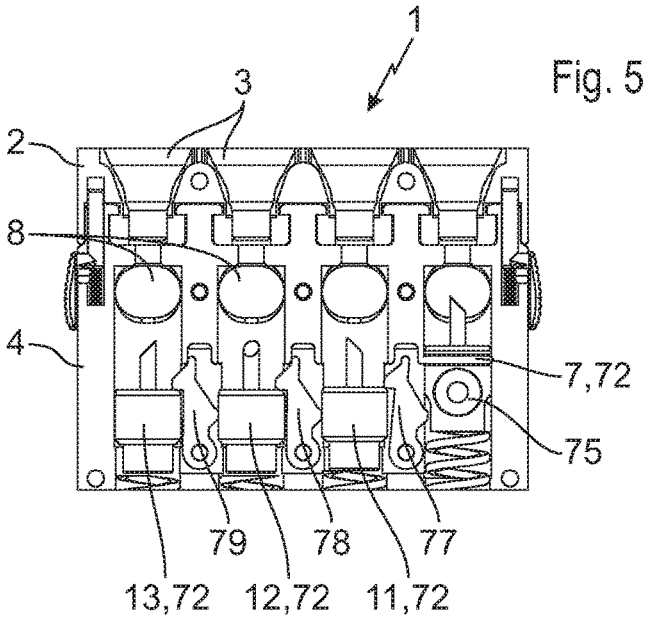
FIG. 5 is partial front cross-sectional views of an embodiment variant of the device of FIG. 1 at different steps of the activation.
Figure 6:
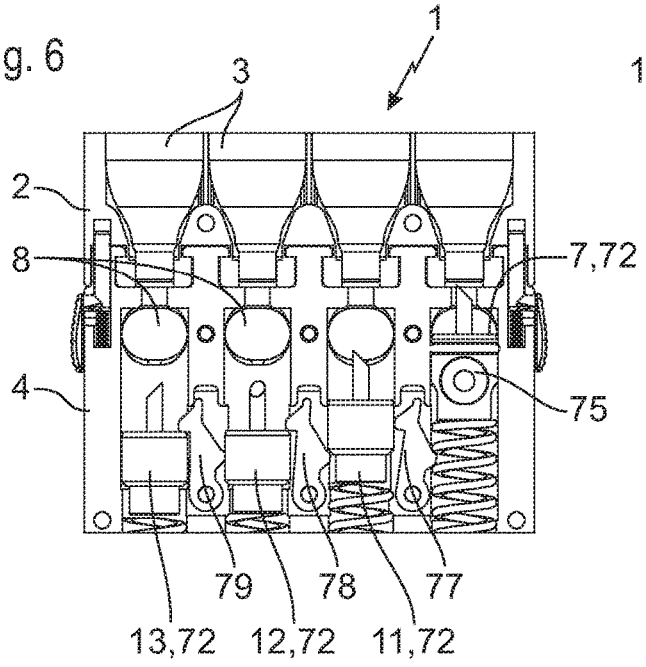
FIG. 6 is partial front cross-sectional views of an embodiment variant of the device of FIG. 1 at different steps of the activation.

In reference to FIGS. 4 to 6, according to a particularly advantageous embodiment variant, the release casing 4 of the inflation device 1 only comprises a striker device 7, thus called first striker device 7, equipped with a retaining member of the pin 75 type likely to be secured to one single strap 10, said first striker device 7 being associated with the cartridge 3 located at one of the ends of the row of cartridges 3 contained in the storage casing 2. The release casing 4 of the inflation device 1 comprises at least one other striker device 11, 12, 13, thus called second striker device 11, 12, 13, equipped with a retaining member of the latch 77, 78, 79 type, arranged between two first and/or second striker device (s) 7, 11, 12, 13, adjacent and pivoting about an axis perpendicular to the plane containing the longitudinal axes of the striker devices 7, 11, 12, 13.

In the example represented, the release casing 4 of the inflation device 1 comprises three second striker devices 11, 12, 13.

The latch 77, 78, 79 of each second striker device 11, 12, 13 pivots between a "blocking" position or it bears against the preceding piston 72, thus in the "normal" position, so as to maintain the following piston 72 in the "normal" position thereof and a "release" position wherein said latch 77 no longer bears against the preceding piston 72, thus in the "activation" position or in the immediate proximity of this position, so as to release the following piston 72 in the "normal" position thereof and make it possible for it to join the "activation" position thereof under the action of the associated thrust member 74.

The latch 77, 78, 79 of each second striker device 11, 12, 13 is preferably mobile by pivoting, but can also be mobile in translation without moving away from the scope of the present invention. The latch 77, 78, 79 of each second striker device 11, 12, 13 is preferably associated with return means extending to bring it back into the "activation" position thereof.

Here, by "preceding" or "following", this means elements or portions of elements located before or after, according to the order going from the first striker device 7 to the last of the second striker devices 13 of the row.

Thus, with this configuration, as soon as the piston 72 of the first striker device 7 is released by the disengagement of the pin 75 under the action of the strap 10, said piston 72 will be moved up to the "activation" position thereof, thus the latch 77 located between the first striker device 7 and the following second striker device 11 will pivot so as to release the piston 72 of the second striker device 11 such that it is moved up to the "activation" position thereof. At this stage, the latch 78 located between the second striker device 11 and the following second striker device 12 will itself pivot so as to release the piston 72 of the second striker device 12 such that it is moved up to the "activation" position thereof. At this stage, the latch 79 located between the second striker device 12 and following second striker device 13 will itself pivot so as to release the piston 72 o the second striker device 13 such that it is moved up to the "activation" position thereof.

It is understood that this configuration makes it possible to puncture successively the cartridges 3, which are arranged side-by-side and touching one another so as to form a row, since the one which is associated with the first striker device 7 to the last 13 of the second striker devices of the row, as the retaining member 77 or 78 or 79, of the latch type, makes it possible to release the associated following piston 72 such that it joins the "activation" position thereof, as soon as the preceding piston 72 is in the "activation" position or in the immediate proximity of this position.

Moreover, it is understood that a person skilled in the art will have no difficulty to modify the shapes of the pistons 72 of the first and second striker devices 7, 11, 12, 13 and of the latches 77, 78, 79 to adapt, if necessary, the time difference between the successive release of the pistons 72. A recess can thus be arranged in the pistons 72 to make it possible for a quicker pivoting in the latches 77, 78, 79 and therefore a quicker release of the pistons 72.

Moreover, it is also understood, that with this configuration, the thrust member 74 of the second striker devices 11, 12, 13 can be formed by a portion of the gas contained in the preceding cartridge and injected between the piston 72 and the end of the tube 71 located opposite the storage casing 2.

It is understood that the inflation device 1 according to the invention is in the overall shape of a flattened parallelepiped, of which the dimensions are around:

length=160 millimetres,
width=85 millimetres,
thickness=24 millimetres.

Thus, the inflation device 1 according to the invention, which has a total volume which is very slightly greater than known devices, makes it possible to have a system which is a lot flatter, slightly curved and therefore best suited to the shapes of the human body, which has the following effects:

- less discomfort at the level of the chest and of the groin of the wearer,
- easier to conceal the inflation device 1 under a jacket or a competition riding vest,
- less punching risk during falls on the front thanks to a larger, curved and thinner surface area, which is less protruding.

Finally, the fact of using several cartridges rather than one single cartridge makes it possible the increase the heat exchange surface areas so as to accelerate the heating of the gases, the vaporisation of the gas contained in the cartridges, when this is contained in the liquid state, and therefore the deployment of the inflatable life vest in case of accident.

POSSIBILITY OF INDUSTRIAL APPLICATION

It is understood that the inflation device 1 according to the invention is preferably used for the deployment of an inflatable life vest in case of fall of a motorcyclist or rider. However, it is clear that the inflation device 1 according to the invention can be adapted and used to release the gas for other purposes, such as, for example, fire protection.

Finally, it goes without saying that the inflation device 1 examples according to the invention which has just been described are only specific illustrations, in no case limiting of the invention.

The invention claimed is:

1. An inflation device for an inflatable life vest, comprising:

a storage casing containing at least two pressurized gas cartridges which are arranged side-by-side and touching one another to form a row and a release casing including at least one striker device making it possible, in case of activation, to puncture successively each of said cartridges to release the gas that they contain in gaseous form to the outside of the inflation device through at least one orifice arranged on the release casing, said storage casings and release casings being in the overall shape of a flattened hollow parallelepiped and joined together removably and in a manner that is gastight to the gas contained in said cartridges, said inflation device being wherein the release casing makes it possible for a successive puncturing of each of said cartridges and contains a first striker device associated with the cartridge located at one of the ends of the row of cartridges contained in the storage casing and at least one second striker device associated with the other cartridges, said first and second striker device(s) including a tube inside which slides a piston equipped with a puncturing end arranged on the side of the associated cartridge, a thrust member capable of moving said piston between a normal position wherein the puncturing end of the piston is not in contact with the associated cartridge and an activation position wherein the puncturing end of the piston has punctured the associated cartridge, and a retaining member making it possible to maintain said piston in the normal position thereof and being mobile, in case of activation, to release the piston such that it is moved up to the activation position thereof under the action of the thrust member, the retaining member of each second striker device being a latch mobile between a blocking position wherein it bears against the preceding piston, thus in the normal position, so as to maintain the following piston in the normal position thereof, and a release position wherein it no longer bears against the preceding piston, thus in the activation position or in the immediate proximity of this position, so as to release the following piston in the normal position thereof and make it possible for it to join the activation position thereof under the action of the associated thrust member.

2. The inflation device according to claim 1, wherein the retaining member of the first striker device is a pin capable of being engaged simultaneously in a retaining orifice of the release casing and in a cavity arranged in the piston to maintain it in the normal position and disengaged to release said piston.

3. Inflation device according to claim 2, wherein the thrust member of each second striker device is formed by a portion of the gas contained in the preceding cartridge and injected between the piston and the end of the tube located opposite the storage casing.

4. Inflation device according to claim 2, wherein each thrust member is a helicoidal spring arranged between the piston and the end of the tube located opposite the storage casing.

5. Inflation device according to claim 1, wherein each thrust member is a helicoidal spring arranged between the piston and the end of the tube located opposite the storage casing.

6. Inflation device according to claim 5, wherein the thrust member of each second striker device is formed by a portion of the gas contained in the preceding cartridge and injected between the piston and the end of the tube located opposite the storage casing.

7. Inflation device according to claim 1, wherein the thrust member of each second striker device is formed by a portion of the gas contained in the preceding cartridge and injected between the piston and the end of the tube located opposite the storage casing.

* * * * *